US005188250A

United States Patent [19]

Kovacic et al.

[11] Patent Number: 5,188,250

[45] Date of Patent: Feb. 23, 1993

[54] PLASTIC BEVERAGE BOTTLE WITH TWIST-OFF CLOSURE

[75] Inventors: Theodore J. Kovacic, Bedford; Richard H. Kaufman, Chappaqua, both of N.Y.; Martin M. Bostwick, Norwalk, Conn.; Donald C. Crescenzi, Killingsworth, Conn.; William H. Valls, Harwinton, Conn.; Thomas Bucaccio, Westmount, Canada

[73] Assignee: Kraft General Foods, Inc., Northfield, Ill.

[21] Appl. No.: 893,612

[22] Filed: Jun. 5, 1992

[51] Int. Cl.[5] ..... A61J 1/06

[52] U.S. Cl. ..... 215/32; 215/1 C; 215/31

[58] Field of Search ..... 215/1 C, 31, 32, 33, 215/35, 253, 254, 256, 305; 220/266, 276

[56] References Cited

U.S. PATENT DOCUMENTS

| | | | |
|---|---|---|---|
| Re. 32,379 | 3/1987 | Touzani | 215/1 C |
| D. 199,154 | 9/1964 | Koch | D58/17 |
| D. 245,576 | 8/1977 | Muscatiello et al. | D9/2 |
| D. 248,827 | 8/1978 | Goldschmidt et al. | D9/2 |
| D. 268,810 | 5/1983 | Hartung | D9/301 |
| D. 301,836 | 6/1989 | van Lit | D9/375 |
| D. 304,683 | 11/1989 | Hofer | D9/390 |
| 3,171,446 | 3/1965 | Koch | 141/24 |
| 3,185,353 | 5/1965 | Mercier | 222/206 |
| 3,356,244 | 12/1967 | Witchell | 215/32 |
| 4,207,990 | 6/1980 | Weiler et al. | 220/267 |
| 4,458,818 | 7/1984 | Hansen | 215/32 |
| 4,572,412 | 2/1986 | Brach et al. | 222/527 |
| 4,610,366 | 9/1986 | Estes et al. | 215/1 C |
| 4,620,638 | 11/1986 | Schmidt . | |
| 4,645,078 | 2/1987 | Reyner | 206/524.8 |
| 4,955,493 | 9/1990 | Touzani | 215/100 R |
| 4,995,519 | 2/1991 | Rose et al. | 215/32 |
| 5,046,627 | 9/1991 | Hansen | 215/31 |
| 5,076,452 | 12/1991 | Hashimoto | 215/1 A |

*Primary Examiner*—Allan N. Shoap
*Assistant Examiner*—Nova Stucker
*Attorney, Agent, or Firm*—Thomas R. Savoie

[57] ABSTRACT

A one-piece soft plastic bottle includes a generally cylindrical bottom portion and a tapered upper portion having a flexible tapered bellows at an upper end thereof. A short tapered top tapers outwardly and upwardly from the tapered bellows and includes a top end with a small aperture therein. A closure for the central aperture extends above the top end and is broken away by the user to expose the central aperture. The closure includes a cylindrical extension and large wings extending laterally and downwardly therefrom. Extending from the cylindrical extension is a filling tube which is crimped after filling to close the filling tube.

22 Claims, 3 Drawing Sheets

PLASTIC BEVERAGE BOTTLE WITH TWIST-OFF CLOSURE

FIELD OF THE INVENTION

The present invention relates generally to beverage bottles, and more particularly to an squeezable plastic beverage bottle having a twist-off closure. According to one embodiment, the bottle includes a flexible neck portion, including bellows, in combination with a novel twist-off closure.

BACKGROUND OF THE INVENTION

A bottle design including a breakaway or twist-off closure which is designed to be grasped by children and which includes a concavo-concave bottom portion is disclosed in U.S. Design Pat. No. 304,683 to Hofer and U.S. Pat. No. 5,076,452 to Hashimoto both of which are hereby incorporated by reference. The commercial embodiments of these patented bottles also includes a concave bottom having a curved rim and indentations therein. Other twist-off caps of general interest are disclosed in the following U.S. Pat. Nos.: 3,356,244 (Witchell), 4,207,990 (Weiler et al.), 4,458,818 (Hansen), and 4,620,638 (Schmidt).

An ornamental design for a combined bottle and breakaway closure is disclosed in U.S. Design Pat. No. 248,827 (Goldschmidt et al.), this bottle including a pleated neck portion. Other designs containing a pleated neck portion are disclosed in U.S. Design Pat. No. 268,810 (Hartung), U.S. Design Pat. No. 245,576 (Muscatiello et al.) and U.S. Design Pat. No. 507,059 (Bostwick et al.). A container with a flexible neck is also disclosed in U.S. Design Pat. No. 301,836 (van Lit).

SUMMARY OF THE INVENTION

In accordance with the present invention, a one-piece plastic beverage bottle includes a generally cylindrical bottom portion having a central longitudinal axis. A tapered upper portion, which is generally frustoconical-shaped, tapers inwardly and upwardly from the bottom portion and is also centered about the longitudinal axis. The upper portion may include a flexible tapered bellows at an upper end thereof. A short tapered top tapers outwardly and upwardly from this tapered upper portion and is also centered about the central longitudinal axis. The top includes a top end having a small central aperture. A closure is provided for the small central aperture of the top which extends above the top end and which is subsequently broken away to expose the central aperture when the beverage is to be consumed. Such a bottle is generally shown in FIGS. 1 to 4 of the aforementioned Hashimoto patent.

In general, the closure includes a cylindrical vertical extension of the top end surrounding the aperture and tabs extending laterally from the cylindrical extension on opposite sides thereof. The cylindrical extension preferably includes a filling tube extending upwardly therefrom which is used to fill the beverage bottle and which is subsequently provided with a crimp to close the filling tube after filling.

In order for the bottle to be easily grasped and held, the bottom portion is preferably concavo-concave shaped in vertical cross section. In addition, embossings may be provided therealong.

According to the present invention a one-piece plastic beverage bottle includes a main (bottom and top) portion having a central vertical axis and in which a beverage is contained. A circular top extends upwardly from the main portion and is centered about the central vertical axis. The top includes a top end having a small, central aperture which extends through the top end and a closure for the central aperture. This closure includes: a short neck piece extending upwardly from the top end and surrounding the aperture, a vertical extension of the neck piece, and planar wings extending laterally from the vertical extension on opposite sides thereof and extending vertically downwards from the vertical extension so as to be below the top end and laterally adjacent the top. In use, the wings are twisted about the vertical axis to shear the neck piece and hence to open the aperture for drinking of the beverage in the main portion.

In accordance with a preferred embodiment of the beverage bottle of this invention, the vertical extension is hollow and includes a filling tube extending upwardly therefrom which is pinched closed after filling of the main portion with the beverage. In addition, the wings may each include hollow knobs laterally adjacent the vertical extension which extend outward from each side of the planar wings and connector tubes which fluidly connect the hollow knobs to the hollow vertical extension. The wings also include wing portions extending beyond the knobs, and these wing portions are horizontally rippled for increased strength.

The beverage bottle of this invention is typically formed by an extrusion blow molding process. Using this process, the wing portions may be solid and formed by opposed halves which are tightly locked together by being horizontally rippled and the wings may be connected to the top by a connecting film. Further, the connector tubes are of reduced size which allows blow molding air therethrough during the forming process but which substantially prevents the beverage from passing therethrough during filling of the main portion through the filling tube.

In a preferred embodiment of this invention, the bottle has the main portion provided with a flexible, non-locking tapered bellows immediately adjacent the top. The bellows includes alternating circumferential peaks and valleys, and fillets between the peaks and valleys in a plane of the wings (the joining plane of the bottle during the molding process).

Preferably, the knobs each are vertically elongated and include small vertical ridges therealong. In addition, the neck piece includes a V shaped notch circumferentially thereabout and radially directed toward the vertical axis which makes the neck piece easily broken thereat by twisting of the wings. Further, each wing has an outer profile which is outwardly arc shaped so that the closure has a planar profile which is greater than 1¼ inches across all diameters.

It is an object of the present invention to provide a beverage bottle which is easily-opened, safely-handled, and attractive, particularly for youngsters.

It is also an object of the present invention to provide such a beverage bottle with a flexible bellows at the neck which can be amusing or playful to children.

It is a further object of the present invention to provide such a beverage bottle which is squeezable by children to provide amusement as well as ease of handling.

Still another object of the present invention is to provide a beverage bottle which is easily produced and manufactured as well as filled.

Yet another object of the present invention is to provide a beverage bottle which is relatively rugged so that leaks do not easily develop and which can be stored in lunch boxes or the like.

A still further object of the present invention is to provide a beverage bottle with a twist-off top which is safe for children. In particular, the twist-off top is sized to be large enough to prevent accidental swallowing and the like.

Other features and objects of the present invention are stated in or are apparent from detailed descriptions of presently preferred embodiments of the invention found hereinbelow.

DETAILED DESCRIPTION OF THE PREFERRED EMBODIMENT

Figure 1:
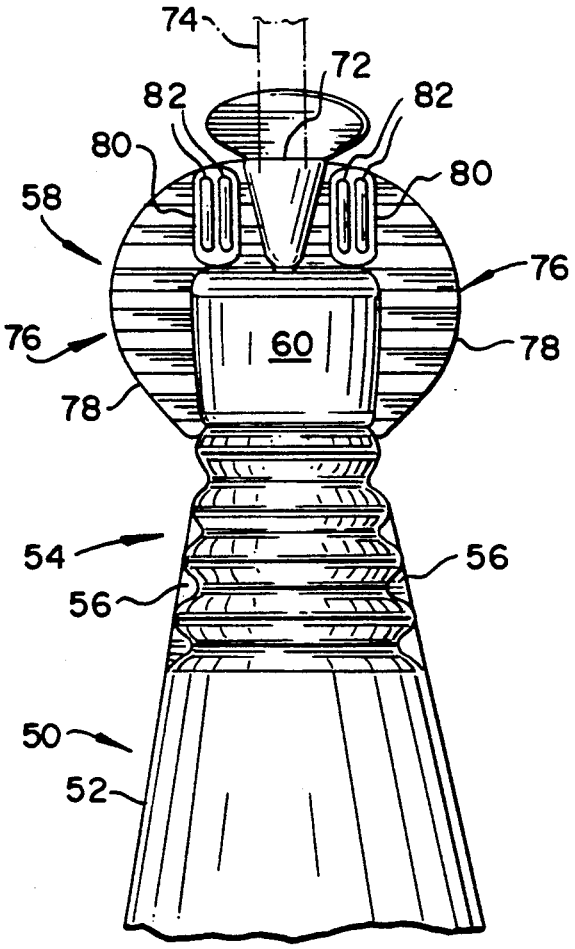
FIG. 1 is a side elevation view of an upper portion of a beverage bottle according to one embodiment of the present invention.
Figure 2:
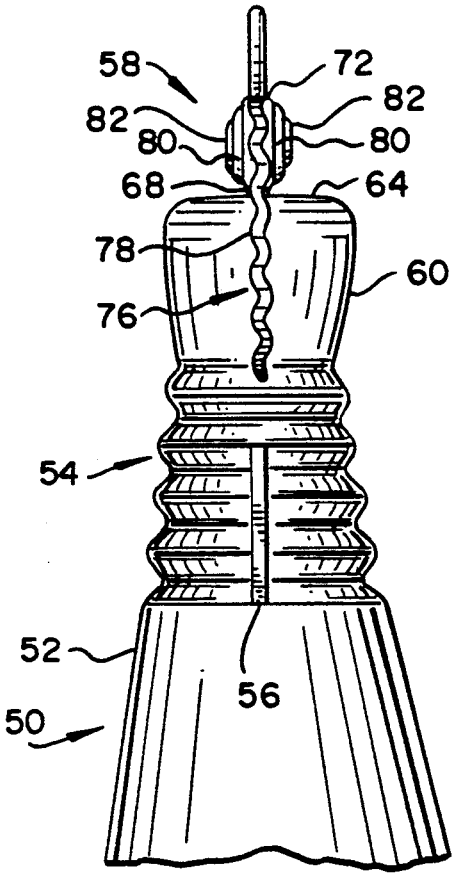
FIG. 2 is a side elevation view of the beverage bottle portion depicted in FIG. 1 rotated 90 degrees.
Figure 3:
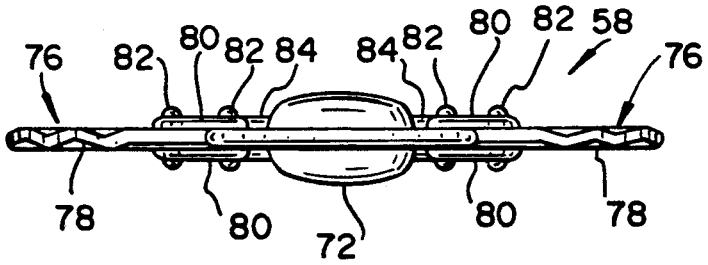
FIG. 3 is a top plan view of the closure for the beverage bottle depicted in FIG. 1.
Figure 4:
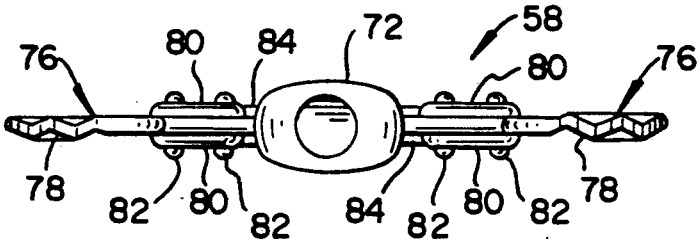
FIG. 4 is a bottom plan view of the closure for the beverage bottle depicted in FIG. 1.
Figure 5:
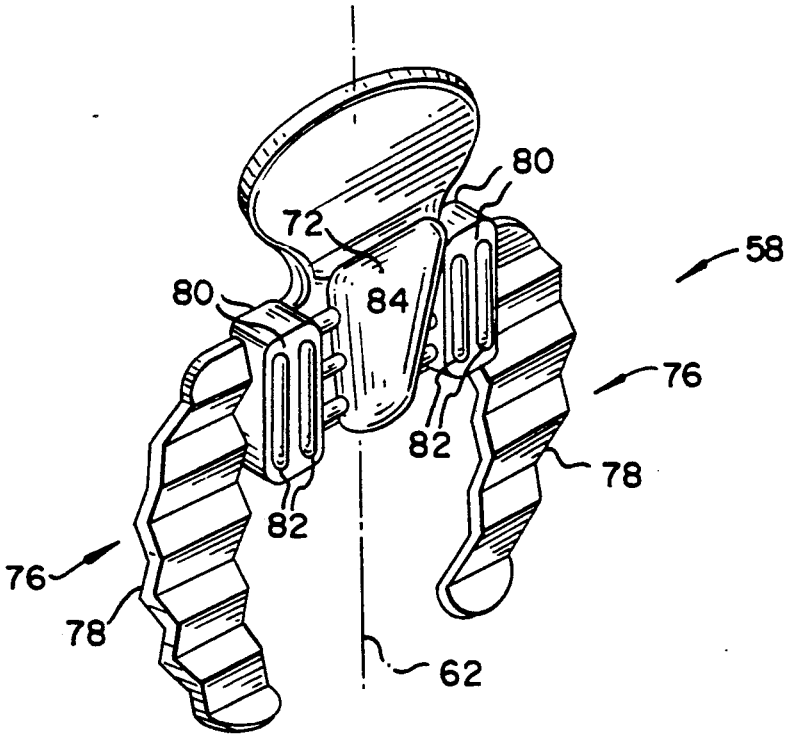
FIG. 5 is a side/top perspective view of the closure for the beverage bottle depicted in FIG. 1.

With reference now to the drawings in which like numerals represent like elements throughout the several views, the top portion of a one-piece plastic beverage bottle 50 is depicted in FIGS. 1 and 2. Beverage bottle 50 includes a generally cylindrical body the lower portion of which (not shown) is typically concavo-concave shaped in lateral profile so as to be easier to grasp. Decorative embossings may be provided about the body for decorations as well as to make the bottle easier to hold. The embossings may depict various fruits where the beverage to be contained is expected to be a variety of fruit-flavored liquids. However, other embossings are also possible.

Provided above the lower portion of the bottle is a tapered upper portion 52 having a generally frustoconical shape tapering inwardly and upwardly. Upper portion 52 includes a flexible tapered bellows 54 at an upper end thereof.

Located above upper portion 52 is a short tapered top 60 tapering outwardly and upwardly from tapered bellows 54. Top 60 includes a top end 64 having a small, central aperture therein.

It should be appreciated that the aperture is normally closed by a closure 58 extending above top end 64. The closure 58 is designed to be broken away to expose the aperture when it is desired to consume the liquid contained in beverage bottle 50. Closure 58 includes a cylindrical vertical extension 72 of top end 64 surrounding the aperture. Extending upwardly from cylindrical extension 72 is a filling tube 74. Filling tube 74 is used as a filling conduit for the bottle. After filling tube 74 is closed off by crimping.

It should be appreciated that beverage bottle 50 is primarily designed for use by children, including young children. Thus, bottom portion and upper portion are relatively slim and have a maximum diameter of preferably less than about two inches. In addition, the one-piece beverage bottle is made of a soft, easily squeezable plastic which is easier to grasp and hold by children and allows them to play with the beverage bottle by squeezing it. The plastic from which the beverage bottle is constructed may be translucent or colored to match the color and/or flavor of the liquid in bottle (e.g., purple for a grape-flavored beverage).

As beverage bottle 50 is particularly designed for children, it should also be appreciated that tapered bellows 54 is particularly advantageous. Bellows 54 provides a source of amusement for the child consuming the liquid as the bellows can be relatively easily moved as the child desires. The pleats of bellows 54 are not lockable, so as to provide the easiest movement. The non-lockable nature of bellows 54 results from a combination of the geometry of the pleats and the use of a soft, resilient, easily-squeezable plastic.

As it is anticipated that beverage bottle 50 will be packed in lunch boxes or the like having confined areas, the presence of bellows 54 also affords bendability to beverage bottle 50 to fit into a confined space. Bellows 54 further acts as a shock absorber, such as when closure 58 is struck. Thus, bellows 54 serves to absorb some of the shock which may be received by closure 58, helping to prevent closure 58 from being accidentally opened and the liquid in beverage bottle 50 spilled. In FIGS. 1 and 2 four pleats making up bellows 20 as shown. However, in actual practice other numbers of pleats may be used. Typically for bottles containing single servings of beverages, from two to six pleats will be used.

As will be appreciated by those skilled in the art, after filling the tube 74 may be crimped and severed above the crimp. Thereafter, the beverage bottle is suitably packaged, shipped and displayed. When it is desired to consume the liquid in the beverage bottle, the thumb and forefinger of the user are placed on opposite sides of the closure, typically at knobs 80, and the bottle is gripped with the other hand. By applying a twisting action to the closure, it is broken away from the aperture. It should be appreciated that the joining line of the closure to top end 64 is weakened during the manufacturing process to make removal of the closure relatively easy by a positive twisting action. Thereafter, the consumer suitably drinks the liquid contained in the opened bottle, using a straw if desired or by squeezing the bottle or by sucking at the aperture.

As bottle 50 is blow molded, it has been found that bellows 54 is subject to weakening at the plane of joining of the two mold halves. Therefore, bellows 54 is additionally provided with fillets 56 at this position between the peaks and valleys forming bellows 54. These fillets 56 help in general to prevent leaks from developing in the joining plane. In addition, fillets 56 are particularly useful as flashing is pulled longitudinally away from bottle 50 to prevent weakenings or actual leaks from bellows 54 at this joining plane. As there is not much force exerted at the topmost peak (due to the wide configuration of the closure thereabove), it will be noted that no fillet is required at this location.

Figure 8:
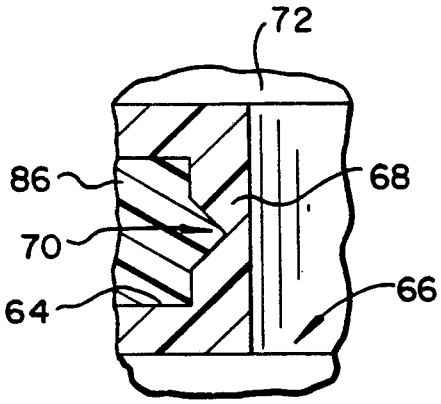
FIG. 8 is an enlarged sectional view of the neck Portion which is circled in FIG. 6 and identified with numeral 8.

Bottle 50 shows the configuration of a closure 58 for a circular top 60. As shown in the figures, top 60 has a central vertical axis 62 about which top 60 is circularly symmetrical. Top 60 includes a top end 64 in which a small, central aperture 66 is provided (see FIG. 8).

Closure 58 is symmetrical about vertical axis 62 and includes a short neck piece 68 extending upwardly from top end 64 and surrounding aperture 66. Neck piece 68 includes a V shaped notch 70 therein (see FIG. 8). Notch 70 extends circumferentially about neck piece 68 and is radially directed toward vertical axis 62 as shown. It will be appreciated that notch 70 provides a weakening of neck piece 68 which is broken or sheared with the twisting of closure 58. Closure 58 is thus removable from top 60 so that the beverage in main portion 52 can be consumed through aperture 66.

Located above neck piece 68 is a hollow vertical extension 72 thereof. As shown, vertical extension 72 is the remaining part of a filling tube 74 which extends upwardly therefrom and which is depicted as having been crimped closed after filling of main portion 52. This crimping leaves vertical extension with a somewhat wedge shape as shown.

Figure 6:
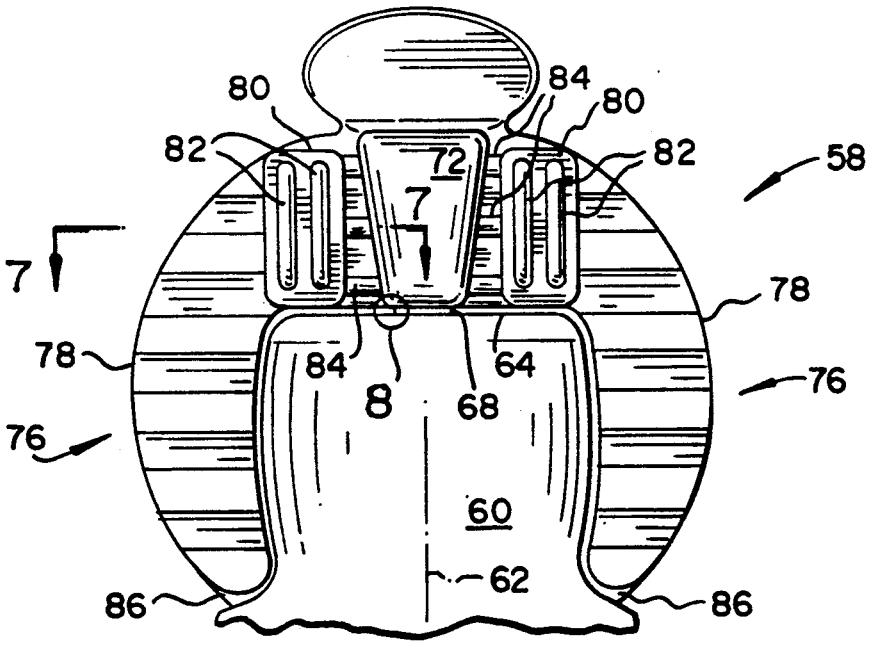
FIG. 6 is an enlarged view of the top of the beverage bottle depicted in FIG. 1.

Extending laterally and downwardly from opposite sides of vertical extension 72 are planar wings 76. Each wing 76 has an outer profile (as shown best in FIGS. 1 and 6) which is outwardly arc shaped. It will be appreciated that wings 76 are designed to extend downwardly below top end 64 and to end adjacent upper bottle portion 52.

Wings 76 of bottle 50 are grasped and rotated about vertical axis 62 to remove closure 58 from top 60. After removal, it will be appreciated that closure 58 is fairly large. In fact, closure 58 is designed so that the planar profile thereof is greater than 1¼ inches across all outer circumferential positions. This dimension is chosen to minimize the risk of swallowing the part (i.e., an inability to pass through a hole of 1¼ inches). Thus, it will be further appreciated that there is minimal risk that closure 58 would be swallowed by a young child even if closure 58 is not disposed of properly after opening of beverage bottle 50. This also makes it relatively safe for small children to open beverage bottle 50 by themselves.

The configuration of closure 58 provides an additional feature. In particular, if wings 76 instead were to extend upwards, then the overall height of bottle 50 would be extended and bottle 50 would be bulkier. This would make the packing and use of bottle 50 somewhat more difficult, particularly for a consumer which tries to place bottle 50 in a restricted space such as a lunch box.

Thus, the chosen configuration of wings 76 provides no vertical extension of closure 58 beyond that otherwise required for easy grasping and twisting thereof. In addition, the location of wings 76 extending down around top 60 provides some protection for wings 76 from being hit or if hit to be stopped from movement by engagement with top 60 so that neck piece 68 is not inadvertently sheared or subject to stress which would cause a leak. Further, this position allows the use of a film to be provided between wings 76 and top 60 as discussed subsequently.

As mentioned above, wings 76 are grasped to open bottle 50. In order to strengthen wings 76 and to direct the twisting forces thereon to neck portion 68, wing portions 78 are rippled as shown. In addition, to help with the grasping of wings 76 and to add rigidity to the top portion of closure 54, wings 76 include knobs 80. Knobs 80 are located laterally adjacent vertical extension 72, and knobs 80 extend outward from each side of planar wings 76 as shown. Knobs 80 are also vertically elongated, and to further help in grasping thereof include small vertical ridges 82 therealong.

As mentioned above, beverage bottle 50 is made by an extrusion blow molding process. Therefore, in order to blow air into knobs 80, connector tubes 84 are provided. Connector tubes 84 provide a fluid communication between hollow vertical extension 72 and knobs 80.

It should be appreciated that knobs 80 are not designed to contain any of the beverage provided in main portion 52, and that it would be a source of bacterial contamination if such liquid did get into knobs 80 during filling. The contamination problem is the result of the manufacturing process, where the bottles are initially made and then later filled. Sterilization of the bottle is achieved by use of a heated beverage, which has a sufficient heat capacity to sterilize large volumes (i.e., main portion 52). However, if the heated beverage did get into knobs 80, there would not be enough heat to sterilize this isolated volume and a bacterial contamination problem could result.

Therefore, it is necessary to prevent the beverage from entering knobs 80 during filling. This is accomplished by making connector tubes 84 fairly small, such as by providing three of them for each knob 80. Thus, while sufficient blow molding air can be passed through connector tubes 84, connector tubes 84 have a small enough inside diameter to prevent a liquid from passing therethrough. As an additional benefit, connector tubes 84 together with knobs 80 also help direct the twisting force exerted on knobs 80 and wings 76 to neck piece 68.

Figure 7:
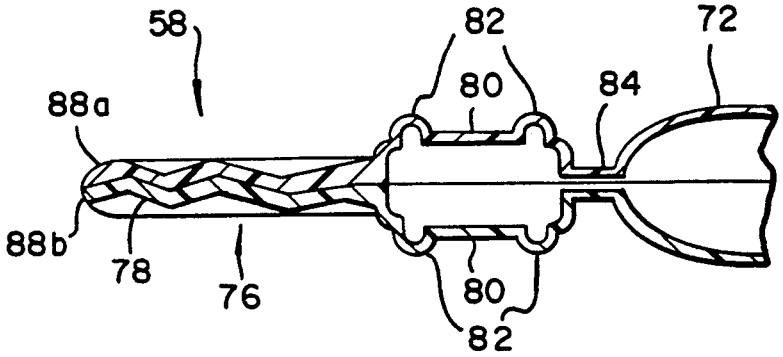
FIG. 7 is cross-sectional plan view of a portion of the closure taken along the line 7—7 in FIG. 6.

In the molding process, knobs 80 and tube connectors 84 also assist in the proper production of wing portions 78. As shown in FIG. 7, wing portions 78 form solid structures, which solid structures are produced by two opposite layers **88*a* and 88*b* of the molding material being drawn together. This drawing together and the even spreading of the correct volume of supplied parison material at this location would be more difficult if not for the presence of hollow knobs 80 and connector tubes 84. Furthermore, it will be appreciated that the rippled configuration of wing portions 78 not only strengthens wing portions 78 as mentioned above but also serves to mechanically lock the two layers 88*a* and 88*b* of wing portions 78 together to increase the strength thereof. If wing portions 78 were not solid, not only would wing portions 78** be significantly weaker, but the forming process would be more difficult.

It should be appreciated that during the blow molding process, the mold halves are specifically configured to leave a connecting film 86 between each wing 76 and top 60. Ordinarily, such a film would not be desired in a molding process as there are two discrete elements being formed (wings 76 and top 60). However, due to the size of closure 58 as discussed above, the parison which is used to form bottle 50 must be larger than the width of closure 58. As a result, after bottle 50 is formed, the excess flashing must be pulled longitudinally along axis 62 away from top 60. As this pulling occurs, stress is placed on wings 76 which tends to pull them along with the flashing. Thus, the presence (tensile strength) of connecting films 86 helps to hold wings 76 in place during the flash removal. In addition, the presence of films 86 also helps to hold wings 76 as well as the rest of closure 58 in place during succeeding operations (such as filling and packaging) to help prevent neck portion 68 from being stressed and possibly developing a leak. And as noted above, fillets 56 are also provided on bellows 54 to help prevent leakage at the joining plane as the flashing is pulled in the longitudinal manner described.

Although films 86 are necessary, it will also be appreciated that the thickness of films 86 must be chosen so that films 86 do not appreciably interfere with the rotation of the rest of closure 58 when it is desired to separate closure 58 from top 60. Producing the exact thickness of thin films 86 with a given material is largely a matter of trial and error with the particular pair of mold masters used to produce bottle 50. Thus, it will be appreciated that when a pair of mold masters are made, the mold masters are typically designed with intersecting and perpendicular surfaces so as to leave little if any film. Any film that would result would be a very thin film which breaks very easily, when even the slightest force is applied. However, by slowly filing down the squared edges of the mold masters which are at the film location, a film can be purposefully and consistently provided. The trial and error of forming these thin films is thus directed at filing these squared edges only so far as necessary to produce a film which is sufficiently thick to stabilize wings 76 while being thin enough not to adversely effect the rotation of closure 58 when desired.

Since the flash removal referred to above requires a relatively strong (as compared to prior art break-away closures) connection between closure 58 and bottle 50 at neck piece 68, the large size of closure 58 is advantageous to provide sufficient mechanical leverage to still obtain easy removal of closure 58. Also the fact that the bottom portions of wings 76 are held in place, at least during the initial stages of twisting closure 58, appears to help focus the twisting forces applied at the location of knobs 80 to provide better shearing action at notch 70 of neck piece 68.

While the present invention has been described with respect to exemplary embodiments thereof, it will be understood by those of ordinary skill in the art that variations and modifications can be effected within the scope and spirit of the invention.

We claim:

1. A one-piece plastic beverage bottle comprising:

an upstanding main bottom portion in which a beverage is contained;

a circular top extending upwardly from said main portion and centered about a central vertical axis, said top including a top end having a small, central aperture which extends through said top end; and a closure for said central aperture of said top end, said closure including a short neck piece extending upwardly from said top end and surrounding said aperture, a vertical extension of said neck piece, and planar wings extending laterally from said vertical extension on opposite sides thereof and extending vertically downwards from said vertical extension so as to be below said top end and laterally adjacent said top whereby said wings are twisted about the vertical axis to shear said neck piece and hence to open said aperture for drinking of the beverage in said main portion.

2. A beverage bottle as claimed in claim 1 wherein said wing portions are horizontally rippled for increased strength.

3. A beverage bottle as claimed in claim 2 wherein each said wing is attached to said top by a connecting film.

4. A beverage bottle as claimed in claim 3 wherein each said wing has an outer profile which is outwardly arc shaped.

5. A beverage bottle as claimed in claim 4 wherein said closure has a planar profile which is greater than 1¼ inches across all diameters.

6. A beverage bottle as claimed in claim 1 wherein said vertical extension is hollow and includes a filling tube extending upwardly therefrom which is pinched closed after filling of said main portion with the beverage.

7. A beverage bottle as claimed in claim 6 wherein said wing portions are horizontally rippled for increased strength.

8. A beverage bottle as claimed in claim 7 wherein said beverage bottle is extrusion blow molded; and wherein said wing portions are solid and are horizontally rippled and each said wing is connected to said top by a connecting film.

9. A beverage bottle as claimed in claim 8 wherein said main portion includes a flexible, non-locking tapered bellows immediately adjacent said top, said bellows including alternating circumferential peaks and valleys.

10. A beverage bottle as claimed in claim 9 wherein said neck piece includes a V shaped notch circumferentially thereabout and radially directed toward the vertical axis which makes said neck piece easily broken thereat by twisting of said wings.

11. A beverage bottle as claimed in claim 10 wherein each said wing has an outer profile which is outwardly arc shaped.

12. A beverage bottle as claimed in claim 11 wherein said closure has a planar profile which is greater than 1¼ inches across all diameters.

13. A beverage bottle as claimed in claim 1 wherein said neck piece includes a V shaped notch circumferentially thereabout and radially directed toward the vertical axis which makes said neck piece easily broken thereat by twisting of said wings.

14. A beverage bottle as claimed in claim 13 wherein said main portion includes a flexible, non-locking tapered bellows immediately adjacent said top, said bellows including alternating circumferential peaks and valleys.

15. A beverage bottle as claimed in claim 14 wherein each said wing is additionally attached to said top by a connecting film which extends therebetween.

16. A beverage bottle as claimed in claim 15 wherein said wings are horizontally rippled for increased strength.

17. A beverage bottle as claimed in claim 2 wherein said wing portions are solid and horizontally rippled.

18. A beverage bottle as claimed in claim 17 wherein each said wing is connected to said top by a film.

19. A beverage bottle as claimed in claim 1 wherein each said wing is additionally attached to said top by a connecting film which extends therebetween.

20. A beverage bottle as claimed in claim 19 wherein each said wing has an outer profile which is outwardly arc shaped.

21. A beverage bottle as claimed in claim 20 wherein said closure has a planar profile which is greater than 1¼ inches across all diameters.

22. A beverage bottle as claimed in claim 21 wherein said main portion includes a flexible, non-locking tapered bellows immediately adjacent said top, said bellows including alternating circumferential peaks and valleys.

* * * * *

US005188250A

REEXAMINATION CERTIFICATE (2330th)

United States Patent [19]

[11] B1 5,188,250

Kovacic et al.

[45] Certificate Issued Jul. 5, 1994

[54] PLASTIC BEVERIDGE BOTTLE WITH TWIST-OFF CLOSURE

[75] Inventors: Theodore J. Kovacic, Bedford; Richard H. Kaufman, Chappaqua, both of N.Y.; Martin M. Bostwick, Norwalk, Conn.; Donald C. Crescenzi, Killingsworth, Conn.; William H. Valls, Harwinton, Conn.; Thomas Bucaccio, Westmount, Canada

[73] Assignee: Kraft General Foods, Inc., Northfield, Ill.

Reexamination Request:
No. 90/003,092, Jun. 4, 1993

Reexamination Certificate for:

| | |
|---|---|
| Patent No.: | **5,188,250** |
| Issued: | **Feb. 23, 1993** |
| Appl. No.: | **893,612** |
| Filed: | **Jun. 5, 1992** |

[51] Int. Cl.[5] ..... A61J 1/06

[52] U.S. Cl. ..... 215/32; 215/1 C; 215/31

[58] Field of Search ..... 215/1 C, 31, 32, 33, 215/35, 253, 254, 256, 305; 220/266, 276; 222/541

[56] References Cited

U.S. PATENT DOCUMENTS

| | | | |
|---|---|---|---|
| D. 304,683 | 11/1989 | Hofer | D9/390 |
| D. 324,333 | 3/1992 | Griffin et al. | D9/529 |
| 2,044,837 | 6/1936 | Davis . | |
| 2,342,372 | 2/1944 | Scherer | 215/32 X |
| 3,204,835 | 9/1965 | Michel | 215/32 X |
| 3,272,366 | 9/1966 | Ikeda | 215/32 X |
| 3,356,244 | 12/1967 | Witchell | 215/32 |
| 3,366,289 | 1/1968 | Badavas et al. | 222/541 |
| 3,416,712 | 12/1968 | Shastal . | |
| 3,721,360 | 3/1973 | Collie | 215/32 |
| 4,207,990 | 6/1980 | Weiler et al. | 220/267 |
| 4,248,227 | 2/1981 | Thomas | 215/32 X |
| 4,458,818 | 7/1984 | Hansen | 215/32 |
| 4,566,613 | 1/1986 | Anscomb | 215/32 X |
| 4,669,640 | 6/1987 | Ando et al. . | |
| 4,785,951 | 11/1988 | Bennett | 215/32 |
| 4,795,065 | 1/1989 | Ashizawa et al. . | |
| 4,979,630 | 12/1990 | Rose et al. | 215/32 |
| 5,076,452 | 12/1991 | Hashimoto | 215/1 A |

FOREIGN PATENT DOCUMENTS

| | | | |
|---|---|---|---|
| 2454191 | 5/1976 | Fed. Rep. of Germany | 215/32 |
| 2039267 | 8/1980 | United Kingdom | 215/32 |

*Primary Examiner*—Allan N. Shoap

[57] ABSTRACT

A one-piece soft plastic bottle includes a generally cylindrical bottom portion and a tapered upper portion having a flexible tapered bellows at an upper end thereof. A short tapered top tapers outwardly and upwardly from the tapered bellows and includes a top end with a small aperture therein. A closure for the central aperture extends above the top end and is broken away by the user to expose the central aperture. The closure includes a cylindrical extension and large wings extending laterally and downwardly therefrom. Extending from the cylindrical extension is a filling tube which is crimped after filling to close the filling tube.

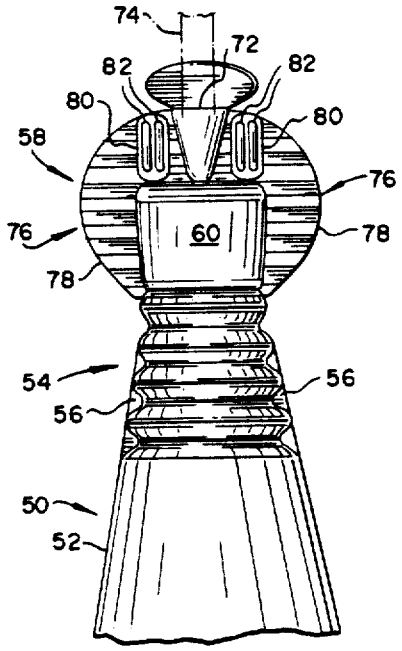

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

ONLY THOSE PARAGRAPHS OF THE SPECIFICATION AFFECTED BY AMENDMENT ARE PRINTED HEREIN.

Column 3, lines 55-58:

Located above upper portion 52 is a short tapered top 60 tapering outwardly and upwardly from tapered bellows 54. Top 60 includes a top end 64 having a small, central aperture therein. *Top 60 forms a mouth portion which is suitable for introduction into a human mouth.*

AS A RESULT OF REEXAMINATION, IT HAS BEEN DETERMINED THAT:

Claims 1, 8 and 17 are determined to be patentable as amended.

Claims 2-7, 9-16 and 18-22, dependent on an amended claim, are determined to be patentable.

New claims 23-33 are added and determined to be patentable.

1. A one-piece plastic beverage bottle comprising:

an upstanding [main bottom] *lower* portion *and an upwardly and inwardly-tapered upper portion* in which a beverage is contained;

a circular top *forming a mouth portion suitable for introduction into a human mouth, said top* extending upwardly from *said tapered upper portion with* said [main portion] *lower and upper portions* [and] centered about a central vertical axis, said top including a top end having a small, central aperture which extends through said top end; and a closure for said central aperture of said top end, said closure including a short neck piece extending upwardly from said top end and surrounding said aperture, a vertical extension of said neck piece, and planar wings extending laterally from said vertical extension on opposite sides thereof and extending vertically downwards from said vertical extension so as to be below said top end [and] *, to be* laterally adjacent *and down around* said top *and to end adjacent said tapered upper portion;* whereby said wings are twisted about the vertical axis to shear said neck piece and hence to open said aperture for drinking of the beverage in said main portion.

8. A beverage bottle as claimed in claim 7 wherein said beverage bottle is extrusion blow molded; and wherein said wing portions are solid [and are horizontally rippled] and each said wing is connected to said top by a connecting film.

17. A beverage bottle as claimed in claim 2 wherein said wing portions are solid [and are horizontally rippled].

*23. A beverage bottle as claimed in claim 1 wherein said top includes a generally-vertical side wall which tapers outwardly and upwardly; and wherein said wings extend along at least an entire length of said generally-vertical side wall.*

*24. A one-piece plastic beverage bottle comprising:*

*an upstanding main bottom portion in which a beverage is contained;*

*a circular top forming a mouth portion suitable for introduction into a human mouth, said top extending upwardly from said main portion and centered about a central vertical axis, said top including a top end having a small, central aperture which extends through said top end, and said mouth portion and said main portion being vertically inclined adjacent an intersection thereof to form a peripheral concave recess; and*

*a closure for said central aperture of said top end, said closure including*

*a short neck piece extending upwardly from said top end and surrounding said aperture,*

*a vertical extension of said neck piece, and*

*planar wings extending laterally from said vertical extension on opposite sides thereof and extending vertically downwards from said vertical extension so as to be below said top end and laterally adjacent said concave recess whereby said wings are twisted about the vertical axis to shear said neck piece and hence to open said aperture for drinking of the beverage in said main portion.*

*25. A beverage bottle as claimed in claim 24 wherein said wings extend at least to said intersection.*

*26. A beverage bottle as claimed in claim 24 wherein each said wing is attached to said top by a connecting film.*

*27. A beverage bottle as claimed in claim 26 wherein each said wing has an outer profile which is outwardly arc shaped.*

*28. A beverage bottle as claimed in claim 25 wherein said closure has a planar profile which is greater than 1¼ inches across all diameters.*

*29. A one-piece plastic beverage bottle comprising:*

*an upstanding main bottom portion in which a beverage is contained;*

*a circular top forming a mouth portion suitable for introduction into a human mouth, said top extending upwardly from said main portion and centered about a central vertical axis, said top including (a) a generally horizontally disposed top end having a small, central aperture which extends through said top end, (b) a generally vertical side wall, and (c) a corner where said horizontal top end and said vertical side wall meet; and*

*a closure for said central aperture of said top end, said closure including*

*a short neck piece extending upwardly from said top end and surrounding said aperture,*

*a vertical extension of said neck piece, and*

*planar wings extending laterally from said vertical extension on opposite sides thereof and extending vertically downwards from said vertical extension past said corner so as to be below said top end and laterally adjacent said vertical side wall of said top whereby said wings are twisted about the vertical axis to shear said neck piece and hence to open said*

*aperture for drinking of the beverage in said main portion.*

*30. A beverage bottle as claimed in claim 29 wherein said generally-vertical side wall tapers outwardly and upwardly from said main bottom portion; and wherein said wings extend at least along an entire length of said vertical side wall.*

*31. A beverage bottle as claimed in claim 29 wherein each said wing is attached to said top by a connecting film.*

*32. A beverage bottle as claimed in claim 31 wherein each said wing has an outer profile which is outwardly arc shaped.*

*33. A beverage bottle as claimed in claim 31 wherein said closure has a planar profile which is greater than 1¼ inches across all diameters.*

* * * * *